US009147924B2

(12) United States Patent
Anthony et al.

(10) Patent No.: US 9,147,924 B2
(45) Date of Patent: Sep. 29, 2015

(54) WAVEGUIDE TO CO-PLANAR-WAVEGUIDE (CPW) TRANSITION

(75) Inventors: Theodore K. Anthony, Randallstown, MD (US); Amir I. Zaghloul, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 831 days.

(21) Appl. No.: 13/224,579

(22) Filed: Sep. 2, 2011

(65) Prior Publication Data

US 2013/0057358 A1 Mar. 7, 2013

(51) Int. Cl.
*H01P 5/107* (2006.01)

(52) U.S. Cl.
CPC ..... *H01P 5/107* (2013.01)

(58) Field of Classification Search
CPC ..... H01P 5/107
USPC ..... 333/21 R, 26, 248, 254
See application file for complete search history.

(56) References Cited

U.S. PATENT DOCUMENTS

| | | | | |
|---|---|---|---|---|
| 4,636,753 | A | 1/1987 | Geller et al. | |
| 6,028,483 | A * | 2/2000 | Shealy et al. | 330/286 |
| 6,573,803 | B1 * | 6/2003 | Ziegner et al. | 333/26 |
| 7,463,110 | B2 * | 12/2008 | Lapierre et al. | 333/26 |
| 2002/0033744 | A1 * | 3/2002 | Sengupta et al. | 333/157 |

* cited by examiner

*Primary Examiner* — Benny Lee
*Assistant Examiner* — Jorge Salazar, Jr.
(74) *Attorney, Agent, or Firm* — Alan I. Kalb

(57) ABSTRACT

Certain embodiments relate to a waveguide/coplanar waveguide (CPW) transition assembly adapted to transition RF signals from a waveguide to a coplanar waveguide (CPW), the waveguide/CPW transition assembly having at least some peripheral walls and including a central waveguide transition septum having the CPW disposed therein. The waveguide/coplanar waveguide (CPW) transition assembly includes an electronic component coupled to the CPW, and control circuitry operationally coupled with the electronic component. Portions of the control circuitry at least partially extend from outside of the at least some peripheral walls to within the at least some peripheral walls.

4 Claims, 4 Drawing Sheets

WAVEGUIDE TO CO-PLANAR-WAVEGUIDE (CPW) TRANSITION

GOVERNMENT INTEREST

Governmental Interest—The invention described herein may be manufactured, used, and licensed by or for the U.S. Government.

FIELD OF THE INVENTION

The present disclosure relates to waveguides, and particularly to transitions between different types of waveguides.

BACKGROUND

Waveguides convey electromagnetic transmission between locations. Waveguides can rely on total internal reflection to provide high transmission characteristics. Reducing impurities in the waveguide transmission material can increase the transmission percentage. Maintaining the cross-sectional configuration of the waveguide is critical to limit transmission losses, so discontinuities in peripheral walls of waveguides are limited.

Transitioning between waveguides with different configurations and/or materials provides a potential source for energy loss and signal degradation. A variety of waveguide couplers limit losses of the energy of the waves traversing between waveguides.

SUMMARY

Embodiments of the present invention relate to waveguide to coplanar waveguide (CPW) transition assemblies. In some embodiments, a waveguide/coplanar waveguide (CPW) transition assembly is adapted to transition RF signals from a waveguide to a coplanar waveguide (CPW), the waveguide/CPW transition assembly having at least some peripheral walls (waveguide walls) and including a central waveguide transition septum having the CPW disposed therein. The waveguide/coplanar waveguide (CPW) transition assembly may include an electronic component coupled to the CPW. Control circuitry may be operationally coupled with the electronic component. Portions of the control circuitry at least partially extend from outside of the at least some peripheral walls to within the at least some peripheral walls.

In some embodiments, an apparatus may include an RF waveguide configured to transmit RF waves; a waveguide/coplanar waveguide (CPW) transition assembly having at least some peripheral walls and configured to transition the RF waves from the RF waveguide to a coplanar waveguide (CPW), the waveguide/CPW transition assembly comprising a central waveguide transition septum that includes the CPW, wherein the waveguide/CPW transition assembly is adapted to receive or transmit at least some of the RF waves from the RF waveguide to the CPW; an electronic component positioned within the peripheral walls and positioned relative to the CPW to define an electric field applied to the CPW; and control circuitry operationally coupled with the electronic component, wherein portions of the control circuitry at least partially extend from outside of the at least some peripheral walls to within the peripheral walls.

BRIEF DESCRIPTION OF THE FIGURES

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
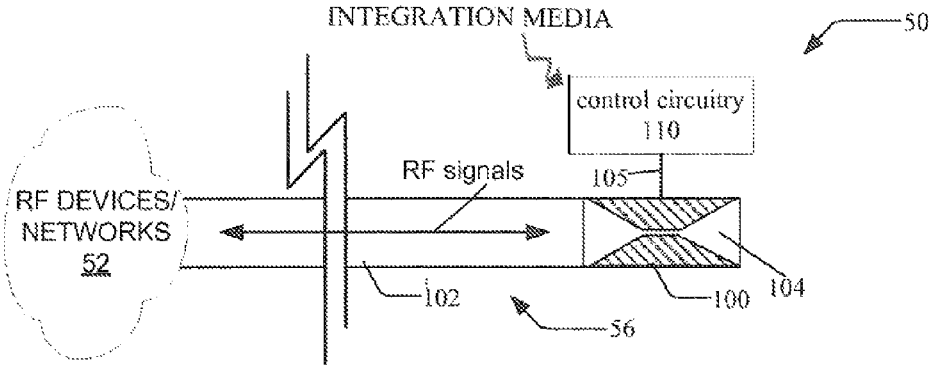
FIG. 1 is a schematic view of a waveguide/co-planar waveguide (CPW) transition assembly in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

FIG. 1 is a schematic view of a Radio Frequency (RF) waveguide/CPW transition assembly 100, transitioning between an RF-waveguide 102 and a co-planar waveguide (CPW) 104 in accordance with some embodiments of the present invention. For example, as discussed in greater detail below, the waveguide-to-CPW transition 100 may include a dielectric septum of small thickness with a tapered metallization on one side. The center portion of the transition accommodates the CPW circuit and its length may be determined accordingly. The center conductor of the CPW extends through the whole length of the transition to create a CPW with a decreasing width of the slot between the center conductor and the co-planar ground planes to produce the match across the frequency band. Rectangular openings in the top and bottom walls of the waveguide provide mechanisms for biasing the components that are mounted on the CPW.

Figure 2:
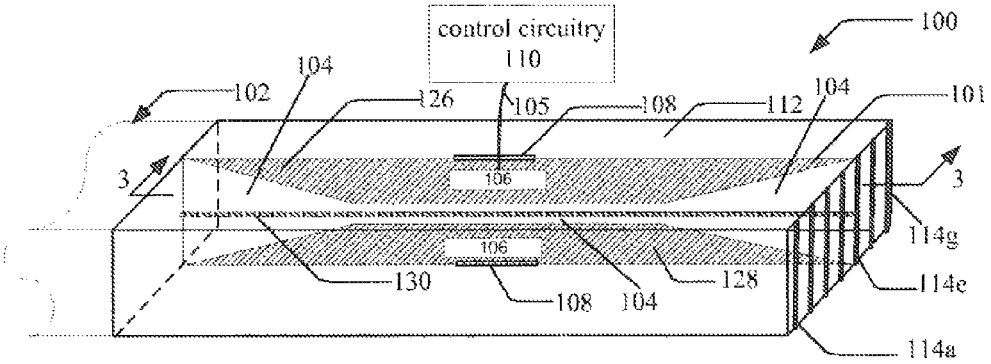
FIG. 2 is a perspective view of an embodiment of a waveguide/co-planar waveguide (CPW) transition assembly.

FIG. 2 is a perspective view of the Radio Frequency (RF) waveguide/CPW transition assembly 100 in accordance with some embodiments of the present invention. The RF waveguide/CPW transition assembly 100 includes the RF-waveguide 102, the CPW 104, and an at least one electronic component 106. Certain embodiments of the waveguide/CPW transition assembly 100 is configured such that the at least one CPW 104 and the at least one electronic component 106 are at least partially integrated therein. Certain aspects of the at least one electronic component 106 can be at least partially electric based, electro-mechanical based, electro-chemical based, electro-medical based, and/or simply electronic based.

One RF waveguide 102 may be operationally coupled with the CPW 104 to form the waveguide/CPW transition assembly 100. The waveguide/CPW transition assembly 100 may be considered a continuum of the RF waveguide 102. There should be little energy loss in the electromagnetic transmission being conveyed along the center conductor 130 of the CPW 104, also along the RF-waveguide 102. Certain embodiments of the RF waveguide/CPW transition assembly 100 can integrate the at least one electronic component 106 into the RF waveguide/CPW transition assembly 100 such as can be utilized for waveguide-based transmitters or waveguide-based receivers within communication systems, radar systems, or other suitable devices. As such, certain embodiments of the waveguide/CPW transition assembly 100 can act as receivers, transmitters, and/or even en route devices such as repeaters, multiplexers, routers, filters, modulators, etc.

Certain embodiments of the waveguide/CPW transition assembly 100 provide a transition between the RF waveguide 102 and the CPW 104, and, optionally, from the RF waveguide 102 to the CPW 104 and back again to another RF waveguide. The RF waveguide/CPW transition assembly 100 has applications in electronic systems that emphasize a low-loss feature for communications and radar systems, and have numerous civilian or military applications.

Embodiments of the present invention are beneficial to provide a low loss transmission medium. Various embodiments of RF waveguides 102 may be shaped in a rectangular, circular, or other cross sectional shape. The RF waveguides 102 include one or more openings 108 formed through at least one of their peripheral walls 112 (two are shown). The openings 108 allow communications, data, control, information, voltage biases, or other signals to enter or exit the CPW 104. The openings 108 can be used as access to control the microelectronic components to be integrated on the CPW plane.

Certain embodiments of the waveguide/CPW transition assembly 100 include a central waveguide transition septum 101 as shown in FIG. 2. Along the waveguide/CPW transition assembly 100 are some position indicators 114*a* to 114*g* (only 114*a*, 114*e*, and 114*g* are shown by reference characters), in parallel alignment showing a plurality of tapered slot septa that may be provided in substantially parallel alignment with the central waveguide transition septum 101. Other configurations are described in greater detail below.

The electronic components 106 can utilize microstrip, microstrip integrated circuits (MIC), monolithic microwave integrated circuits (MMIC), CPW, etc. or other such technologies. Embodiments provide a low-loss transition between the electronic components 106 and the RF waveguide 102, facilitate use of easily manufactured electronic components 106, with the RF waveguide 102 providing a very low loss transmission medium.

A number of electronic components can be integrated on the CPW 104. A number of electrical conductors 105 apply electrical signals from the control circuitry 110 to the electronic components 106.

Figure 3:
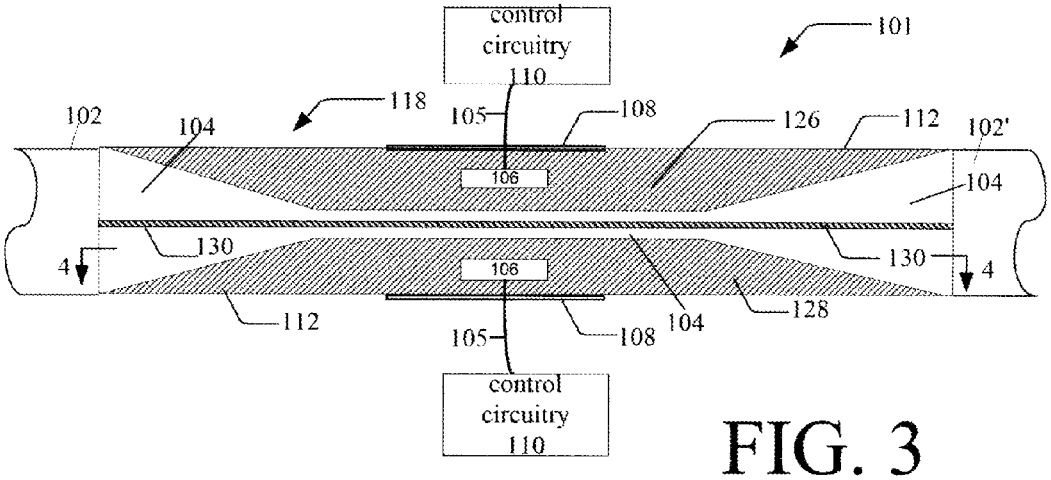
FIG. 3 is a side view of an embodiment of waveguide transition septa taken along the sectional lines 3-3 of FIG. 2.

FIG. 3 is a side view of the central waveguide transition septum 101 taken along the sectional lines 3-3 of FIG. 2. The waveguide/CPW transition assembly 100 can be fabricated using a number of tapered slot septa extending generally vertically from opposing peripheral walls 112 of the RF waveguide/CPW transition assembly 100. The central waveguide transition septum 101 extends along a substantial length of the RF waveguide/CPW transition assembly 100. In general, the central waveguide transition septum 101 has a CPW 104 with a center conductor 130 and outer tapered printed ground planes 128. The other tapered slot septa do not have the center conductor 130. Adjacent tapered slot septa are controllably spaced to control the percentage of the electromagnetic radiation conveyed to the CPW 104. For example, increasing the adjacent tapered slot sition septa spacing will reduce the percentage of conveyed electromagnetic radiation to the CPW 104.

Figure 4:
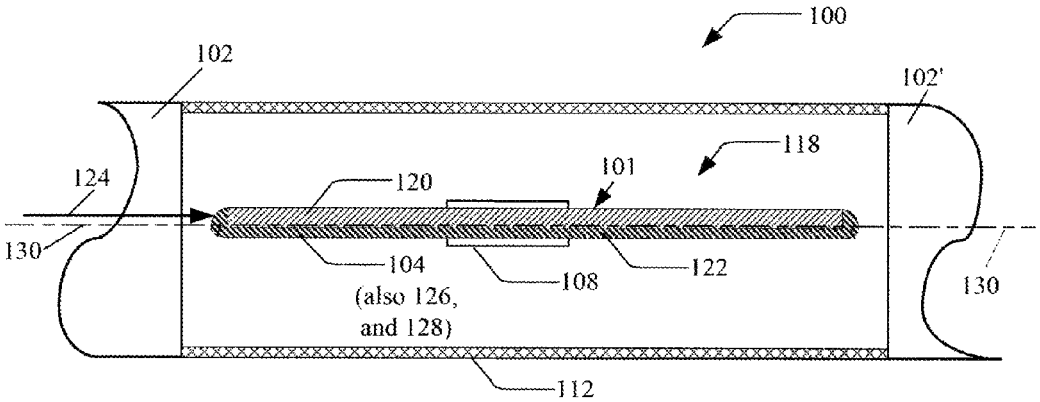
FIG. 4 is a top view of an embodiment of the waveguide/CPW transition assembly as taken along sectional lines 4-4 of FIG. 3.

FIG. 4 is a top view of the waveguide/CPW transition assembly as taken along sectional lines 4-4 of FIG. 3. The central waveguide transition septum 101 includes a substrate CPW structure 118. The configurations, lengths, thickness, etc. of certain embodiments of the CPW 104 of the central waveguide transition septum 101, can be selected based on the types, frequencies, and amplitudes of signals that are transmitted, received, modulated, etc. Considering particularly FIG. 4, the substrate CPW structure 118 includes at least one typically dielectric substrate 120, and on one side having a patterned CPW/ground plane 122 formed thereupon. Certain embodiments of the patterned CPW/ground plane 122 are formed on one side of the substrate 120, wherein the substrate 120 supports the CPW, ground planes 126, 128, and center conductor 130 (such as can be printed on the substrate by photolithographic, semiconductor processing, metallization, ultra-large scale integration (ULSI), or other processes).

Certain embodiments of the patterned CPW/ground plane 122 include the CPW 104 extending between a pair of tapered ground planes 126, 128 along the length of the central waveguide transition septum 101. This provides a CPW 104 having a decreasing width of a slot formed between the tapered ground planes 126, 128 to produce a match across the frequency band, such that the slot of the waveguide would have an optimum frequency. Two openings 108 formed in the top and bottom peripheral walls 112 of the waveguide/CPW transition assembly 100 provide a mechanism for electrically biasing and controlling the components of the central waveguide transition septum 101.

Figure 5:
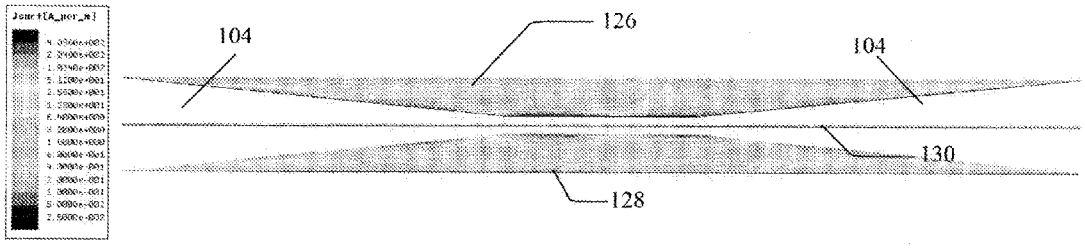
FIG. 5 is an illustrated surface current distribution defining the co-planar waveguide (CPW)

The electronic components 106 provide electric signals to various portions of the waveguide/CPW transition assembly 100, including the tapered ground planes 126 and/or 128. FIG. 5 shows one embodiment of surface current distribution provided largely within the tapered ground planes 126 and 128 regions of the substrate CPW structure 118 as referenced in FIG. 2, such as would be provided by the electronic components 106 or by the waveguide 102. The current distributions should improve the ability to maintain FR-frequency waves traveling along a centerline of the CPW 104 as illustrated at 130. The centerline 130 extends substantially between the two tapered ground planes 126 and 128 along the length of the substrate CPW structure 118.

Figure 6:
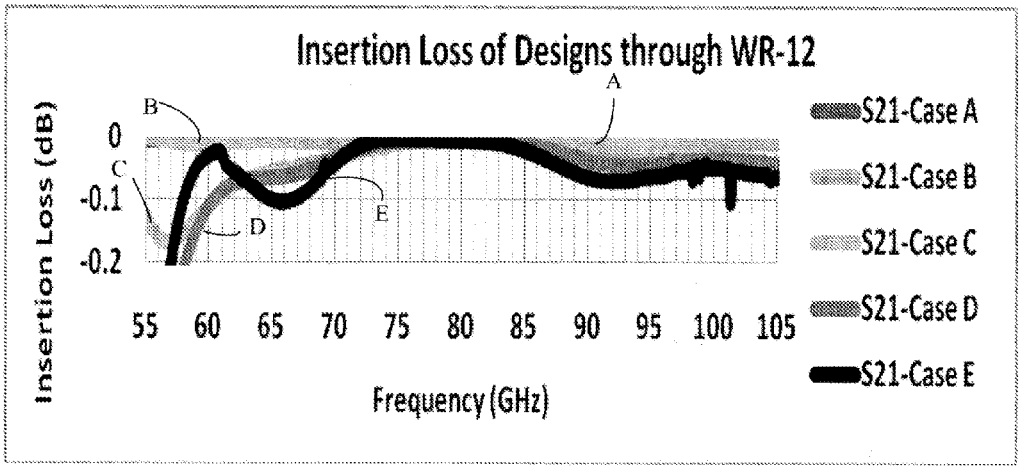
FIG. 6 is a modeled graph of insertion loss versus frequency of the waveguide/CPW transition assembly.
Figure 7:
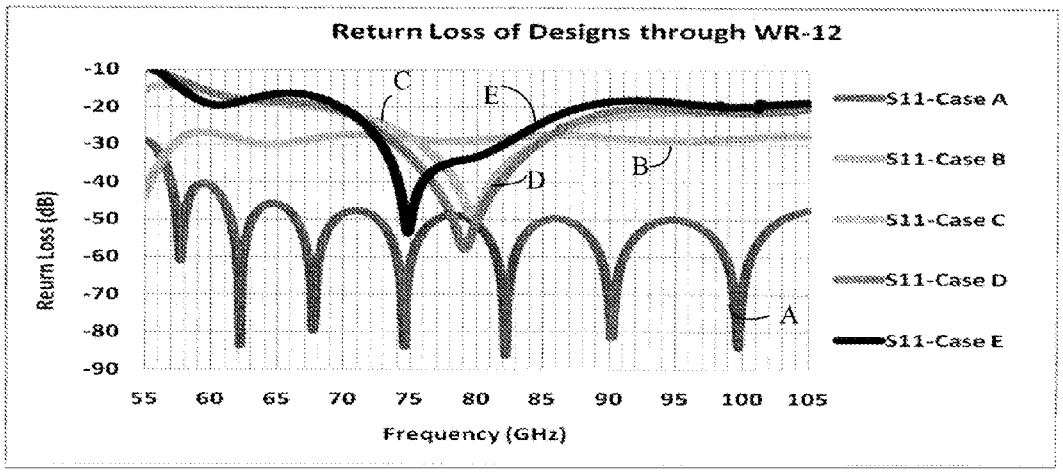
FIG. 7 is a modeled graph of return loss versus frequency of the waveguide/CPW transition assembly.
Figure 8:
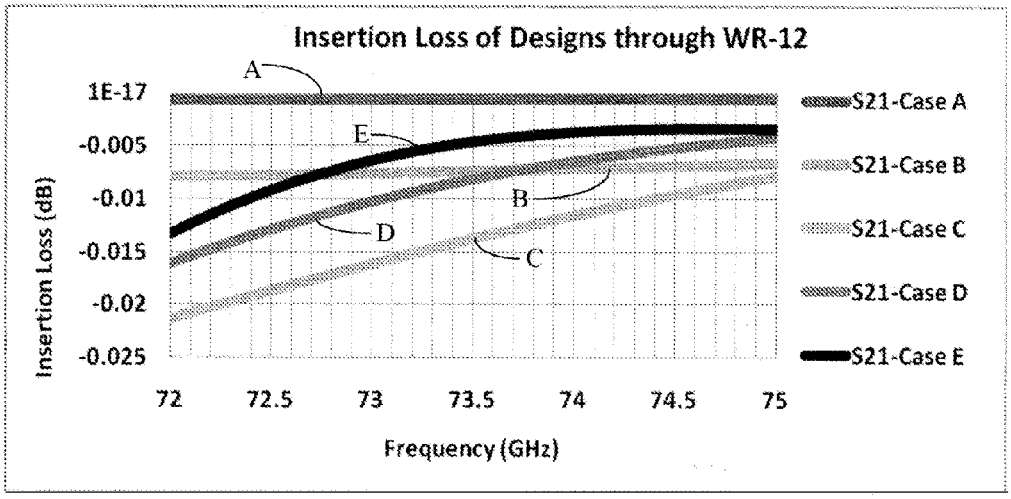
FIG. 8 is another modeled graph of insertion loss versus frequency for the waveguide/CPW transition assembly.

The waveguide/CPW transition assembly 100 may further include a number of equally spaced tapered slot septa situated on both sides of the active transition (e.g., the central waveguide transition septum 101), which advantageously facilitates a very low insertion loss and a good match across a considerable percentage of the frequency band. FIGS. 6, 7, and 8 show models of frequency responses of the waveguide/CPW transition assembly 100 using a full-wave analysis tool (e.g., HFSS™). FIG. 6 is a modeled graph of insertion loss versus frequency for one embodiment of the waveguide/CPW transition assembly. FIG. 7 is a modeled graph of return loss versus frequency for one embodiment of the waveguide/CPW transition assembly. FIG. 8 is another modeled graph of insertion loss versus frequency for the waveguide/CPW transition assembly 100 over the center portion of the frequency band displayed in FIG. 6 and FIG. 7. The S-parameters (corresponding to the insertion and return losses) were calculated with a waveguide input, followed by the transition that simulates to (is modeled to) an output of the RF waveguide 102.

The simulation modeling results from FIGS. 6, 7, and 8 demonstrate good broadband operation of the waveguide/CPW transition assembly 100 within the 60 to 100 GHz bandwidth, with good (i.e., relatively low levels of) insertion and return losses. Within this disclosure, the insertion loss is considered the loss in load power due to the insertion of the waveguide/CPW transition assembly 100 at some point in a transmission system; expressed as the ratio of the power received at the load before insertion of the waveguide to the power received at the load after insertion of the waveguide. By comparison, return loss may be considered as the difference between forward and reflected power for the waveguide.

The simulation modeling of the waveguide/CPW transition assembly 100 is derived with multiple tapered slot septa 114 including the openings 108 show better results particularly in within the bandwidth of 72-75 GHz. A WR-12 rectangular CPW 104 was modeled in the simulation, with the results of the modeling simulation are illustrated for five cases (labeled as "Case A" to "Case E") in each of FIGS. 6, 7, and 8 as described with respect to Table 1.

TABLE 1

Simulation modeling parameters for the cases modeled in FIGS. 6-8

| CASE | Simulation Modeling Parameters (HFSS ™) |
|---|---|
| A | A 15 mm long section of .25 mil thick substrate of Cuflon with no metallization inserted into rectangular wave guide 102 (type WR12) without top and bottom holes. |
| B | A 15 mm long section of .25 mil thick substrate of Cuflon with no metallization inserted into rectangular wave guide 102 (type WR12) with top and bottom holes. |
| C | A 15 mm long section of .25 mil thick substrate of Cuflon with tapered metallization (ground plane and center conductor) transition 104 inserted into rectangular waveguide 102 (type WR12)without top and bottom holes. |
| D | A 15 mm long section of .25 mil thick substrate of Cuflon with tapered metallization (ground plane and center conductor) transition 104 inserted into rectangular waveguide 102 (type WR12)with top and bottom holes. |
| E | Seven equally spaced 15 mm long (septa) sections of .25 mil thick substrate of Cuflon with tapered metallization transition 114 inserted into rectangular waveguide (type WR12) waveguide with top and bottom holes. Center septum (e.g., waveguide transition septum 101) has a printed CPW 104 with center conductor 130. Other 6 septa (tapered slot septa 114) do not have center conductor 130. |

As such, certain embodiments of the waveguide/CPW transition assembly 100 can be configured to couple energy having a very low loss over a broad bandwidth, such as between the RF-waveguide 102 and the CPW 104. The transition provided by certain embodiments of the waveguide/CPW transition assembly is virtually lossless and has an effective bandwidth substantially greater than 50 percent. The effective bandwidth may be considered as the range of wavelengths of radiation (light) it allows to pass through the transition. Certain embodiments of the waveguide/CPW transition assembly 100, as described in this disclosure, can be fabricated as an easily reproduced single-piece module that can be inexpensively produced. Certain embodiments of the waveguide/CPW transition assembly 100 configured with multiple waveguide slot septa show lower insertion loss.

This disclosure provides a number of techniques by which a variety of waveguide transition septa 101 can be integrated within the waveguide/CPW transition assembly 100 associated with the RF waveguide 102, while permitting electronic components to also be integrated within the RF waveguide 102. In different configurations, the electronic components can be accessed, controlled, and even re-programmed via control circuitry 110 extending through opening 108 formed within peripheral walls 112 of the RF-waveguide.

While the foregoing is directed to embodiments of the present invention, other and further embodiments of the invention may be devised without departing from the basic scope thereof.

What is claimed is:

1. An apparatus, comprising:

a waveguide/coplanar waveguide (CPW) transition assembly adapted to transition RF signals from a waveguide having RF waves to a coplanar waveguide (CPW), the waveguide/CPW transition assembly having at least some peripheral walls and including a central waveguide transition septum having the CPW disposed therein;

at least one electronic component coupled to the CPW; and control circuitry operationally coupled with the at least one electronic component, wherein portions of the control circuitry at least partially extend from outside of the at least some peripheral walls to within the at least some peripheral walls, wherein the waveguide/CPW transition assembly includes a plurality of tapered slot septa disposed on either side of, and in substantial alignment with, the central waveguide transition septum, wherein the plurality of tapered slot septa do not include the CPW, wherein the at least one electronic component comprises an integration media by which additional electronic components are operationally associated with the CPW, and wherein the integration media is positioned relative to a substrate.

2. The apparatus of claim 1, further comprising an at least one edge portion of the CPW that extends around the periphery of the substrate surrounding the CPW, at least some of the RF waves encountering the at least one edge portion of the central waveguide transition septum are transitioned into the CPW.

3. The apparatus of claim 2, wherein the at least one edge portion of the CPW comprises a plurality of edge portions, wherein the plurality of edge portions prevent the RF waves encountering the plurality of edge portions from encountering the substrate.

4. An apparatus, comprising:

an RF waveguide configured to transmit RF waves;

a waveguide/coplanar waveguide (CPW) transition assembly having at least some peripheral walls and configured to transition the RF waves from the RF waveguide to a coplanar waveguide (CPW), the waveguide/CPW transition assembly comprising a central waveguide transition septum that includes the CPW, wherein the waveguide/CPW transition assembly is adapted to receive or transmit at least some of the RF waves from the RF waveguide to the CPW;

an electronic component positioned within the at least some peripheral walls and positioned relative to the CPW to affect an electric field that is applied to the CPW; and control circuitry operationally coupled with the electronic component, wherein portions of the control circuitry at least partially extend from outside of the at least some peripheral walls to within the at least some peripheral walls, wherein the waveguide/CPW transition assembly includes a plurality of tapered slot septa disposed on either side of, and in substantial alignment with, the central waveguide transition septum.

* * * * *